United States Patent [19]

Mitchell

[11] Patent Number: 4,873,725

[45] Date of Patent: Oct. 17, 1989

[54] INFANT CARE APRON

[76] Inventor: Tonia L. Mitchell, 4147 Casey, Norcross, Ga. 30093

[21] Appl. No.: 184,185

[22] Filed: Apr. 21, 1988

[51] Int. Cl.[4] ..... A41D 13/04

[52] U.S. Cl. ..... 2/48; 2/51; 2/52

[58] Field of Search ..... 2/48, 49 R, 49 A, 50, 2/51, 88, 114; 446/28; 40/586

[56] References Cited

U.S. PATENT DOCUMENTS

| | | | |
|---|---|---|---|
| 1,470,341 | 10/1923 | Achilli | 2/48 |
| 1,543,584 | 6/1925 | Menke | 2/51 |
| 1,765,009 | 6/1930 | Fedorcak | 2/51 |
| 2,222,782 | 11/1940 | Moses . | |
| 2,222,896 | 11/1940 | Cogburn | 2/50 |
| 2,282,183 | 5/1942 | Harris | 2/50 |
| 2,404,225 | 7/1946 | Green | 2/48 X |
| 2,482,182 | 9/1949 | Henninger | 2/49 |
| 2,593,218 | 4/1952 | Swain | 2/48 |
| 2,727,240 | 12/1955 | Marshall | 2/50 |
| 2,748,517 | 6/1956 | Berkis | 446/28 X |
| 2,767,403 | 10/1956 | Givens | 2/49 R |
| 3,996,620 | 12/1976 | Maine | 2/48 X |
| 4,266,299 | 5/1981 | Beal | 2/51 X |
| 4,441,025 | 4/1984 | McCoy, Jr. | 2/51 X |
| 4,570,268 | 2/1986 | Freeman | 2/114 |
| 4,604,758 | 8/1986 | Grasberger et al. | 2/49 R |
| 4,723,323 | 2/1988 | Wright, Jr. | 2/49 R |
| 4,771,480 | 9/1988 | Stimson et al. | 2/88 |

*Primary Examiner*—Werner H. Schroeder
*Assistant Examiner*—Jeanette E. Chapman
*Attorney, Agent, or Firm*—Harry I. Leon

[57] ABSTRACT

An apron-type garment for the u se of parents of infants in which many of the necessities for child care are kept close at hand. Specialized pockets conveniently located on a front panel of the garment provide for the storage of milk bottles, bibs, diapers, baby powder, and the like. Made of a thick, quilted fabric, the garment not only is gentle against the child's skin but also absorbs moisture and thereby protects the wearer's clothes against their being soiled while the wearer is attending to the needs of the child. The body of the garment includes, in addition to the front panel, two rear panels each of which is about one-half as long as the front panel. Contiguous portions of the front and rear panels form a pair of flared sections covering the wearer's shoulders and extending laterally therefrom. These flared sections together with the lower portions of the rear panels cover the caregiver's back to her waist, thereby allowing her to let the child rest his head on her shoulder, even after a meal, without having to worry about clothes worn beneath this garment becoming solied as the infant exercises a natural tendency to regurgitate.

7 Claims, 4 Drawing Sheets

Fig. 2.
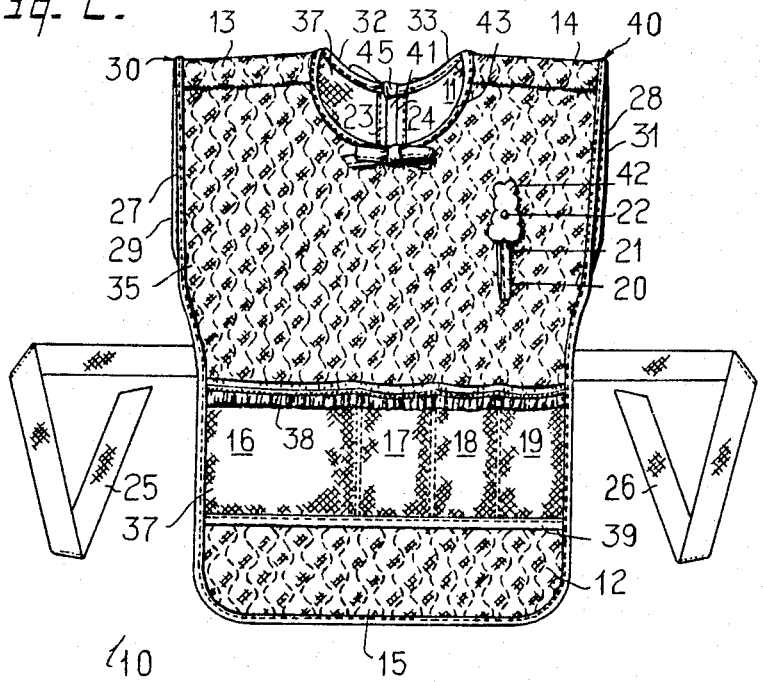
Fig. 4.
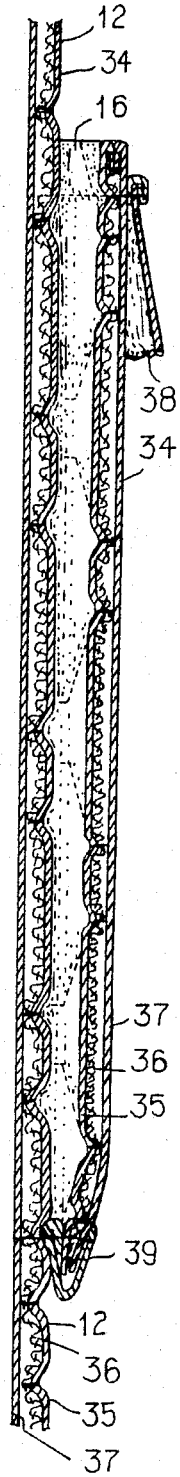
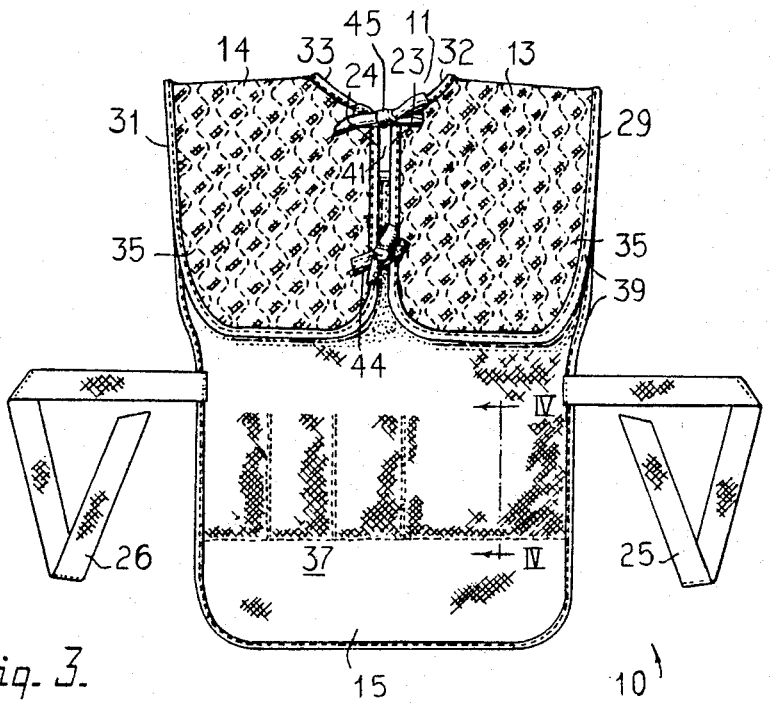
Fig. 3.

Fig. 5.
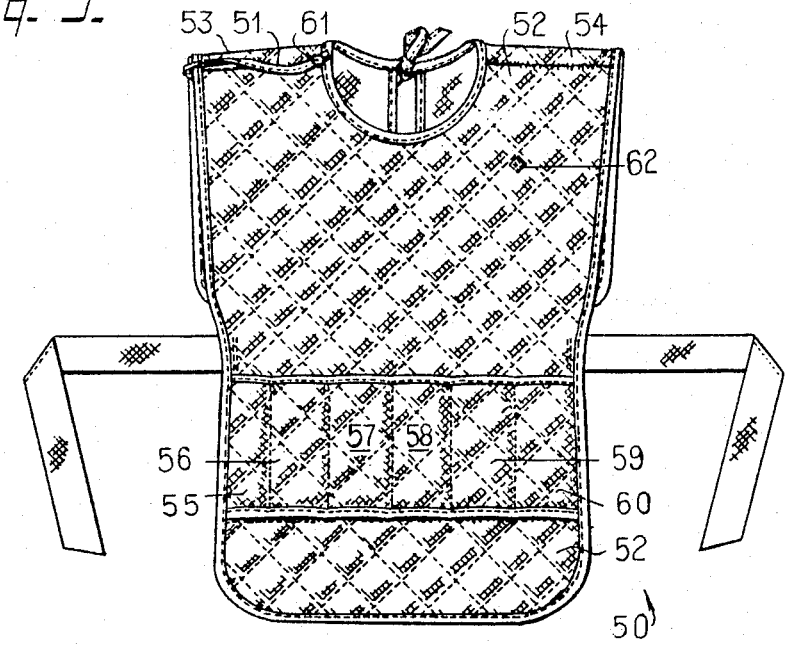
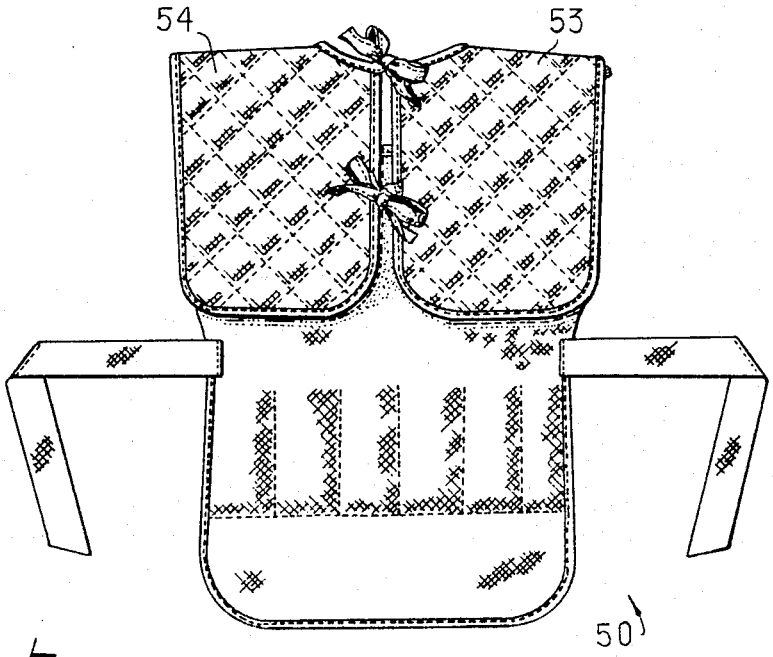
Fig. 6.

Fig. 7.
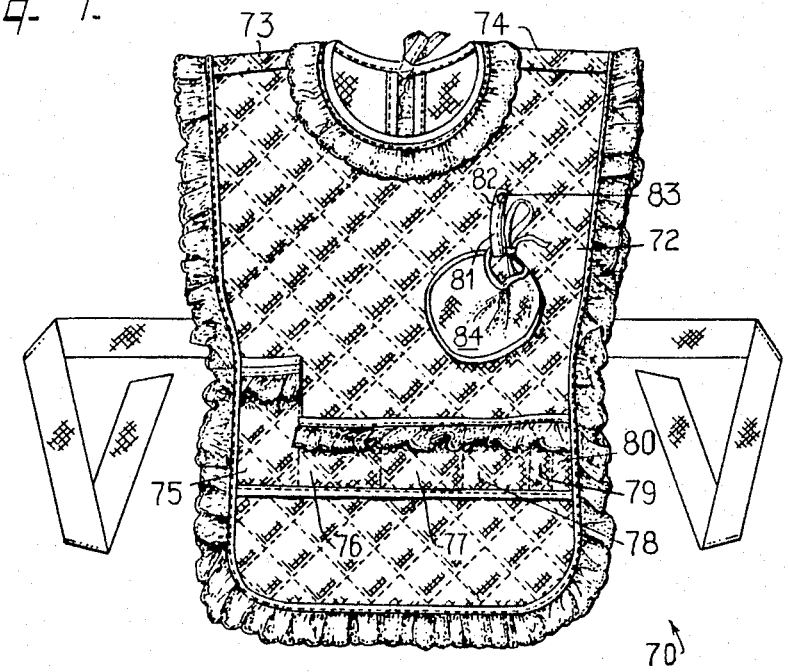
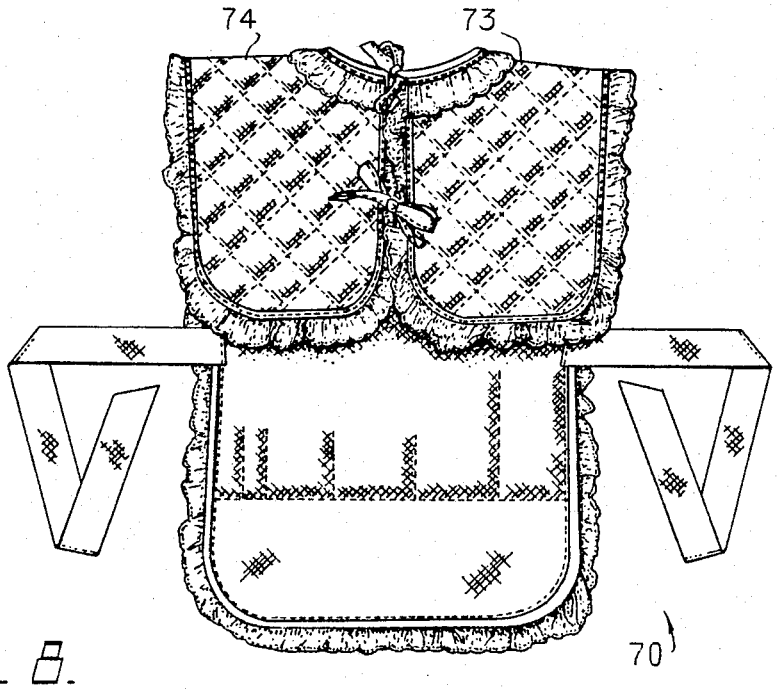
Fig. 8.

INFANT CARE APRON

BACKGROUND OF THE INVENTION

This invention relates to aprons and more particularly to garments used for the care of infants.

Garments in which the tools of a wearer's trade can be conveniently stored are well known. Such a garment is shown, for instance, in U.S. Pat. No. 2,846,685 issued to Ehrich. In more recent years, a similar technology has been applied to aprons used in the home, the sleeveless apron disclosed by Thomas in U.S. Pat. No. D281,638 being an example.

SUMMARY OF THE INVENTION

The object of this invention is to provide an improved apron-type garment for use in the care of infants. The garment according to the present invention contemplates not only an apron that has pockets as well as other means for holding the necessities for child care close at hand so that the caregiver can devote her (his) undivided attention to the child but also a covering for the wearer's clothes sufficiently absorbent and otherwise adequate to protect them from the spills and discharges of the child, including any accidental releases which may originate proximate the backside of one of the wearer's shoulders.

A further object of the present invention is to provide an improved apron-type garment for use in infant care which can be manufactured with present materials and present manufacturing techniques and which can be easily cleaned in the home.

These and other advantages of the invention are apparent from the following detailed description and drawings.

BRIEF DESCRIPTION OF THE DRAWINGS

FIGS. 2 and 3 are frontal and rear elevational views, respectively, of the garment according to FIG. 1;

FIG. 4 is a view in cross-section of the garment according to FIG. 1 taken along the line IV—IV of FIG. 3, but in exaggerated proportions merely for general illustration;

FIGS. 5 and 6 are frontal and rear elevational views, respectively, of a first alternate embodiment of the present invention; and FIGS. 7 and 8 are frontal and rear elevational views, respectively, of a second alternate embodiment of this invention.

Like reference characters indicate corresponding parts throughout the several views of the drawings.

DESCRIPTION OF THE PREFERRED EMBODIMENT

Figure 1:
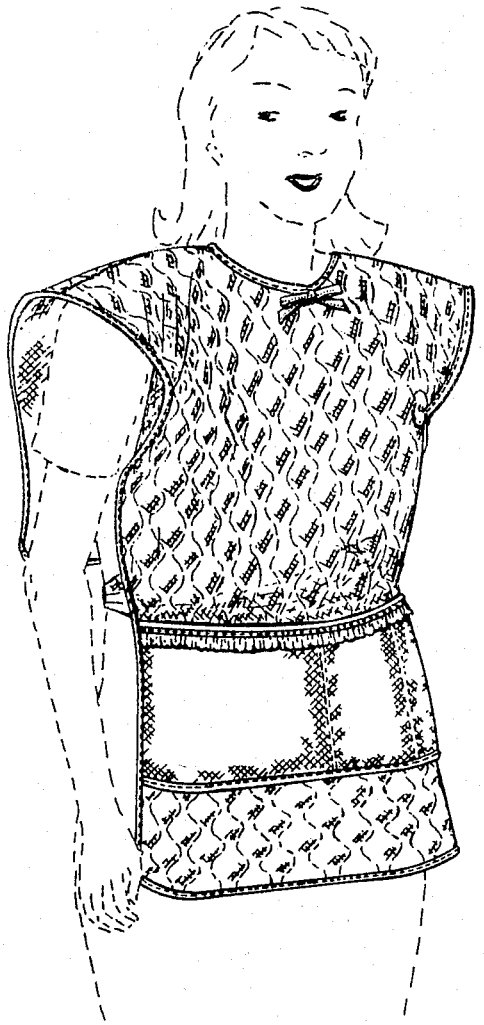
FIG. 1 is a frontal perspective view of a garment according to the present invention in place on a wearer shown in broken lines.

In FIGS. 1 through 4, an apron-type garment, indicated generally by the reference numeral 10, has a front panel 12 to the upper edges of which are stitched two rear panels 13, 14. The panel 12, as illustrated in FIG. 4, as well as the panels 13, 14 are preferably fabricated from a soft, quilted fabric 34 comprising a cotton facing 35, a polyester fill 36 and a cotton liner 37. Alternately, the facing and liner may be made of cotton-polyester material. The fabric 34 should be gentle against a child's skin, air permeable, and absorbent. It is also important that the multilayered fabric 34 give the panels 12, 13, 14 sufficient rigidity that sections of these panels situated proximate any depressions in the contour of the caregiver's body tend to bridge the depressions (FIG. 1). This property of the panels 12, 13, 14 not only creates air pockets between the garment 10 and the caregiver's clothes but also reduces the area of contact between the clothes and any portions of the garment 10 which may have absorbed fluid, thereby reducing the likelihood the fluid will be transferred to the clothes. Under conditions of normal use, fluids spilled or discharged onto the fabric 34 soak into it and dry without soiling clothing contiguous the underside of the garment 10. Moreover, the fabric 34 and the remainder of the materials from which the garment 10 is constructed are preferably washable.

Downwardly of their junctures with the panel 12, the panels 13, 14 are secured to each other along proximate inner edges 23, 24 by tie fasteners 44, 45 each of which includes a pair of ties with one of the ties within each of these pairs being attached to one of said edges (FIG. 3). The panels 12, 13, 14 and the fastener 45, when employed to secure the panels 13, 14 together, define an opening 11 bounded by arcuate edges 32, 33, 43, the edge 43 having a radius of curvature which measures, by way of example, about 4 inches. On the other hand, when the pair of ties comprising the fastener 45 are not tied together, the edges 23, 24 define a slot 41 which communicates with the opening 11. With the fasteners 44, 45, a user can easily adjust the opening 11 to accomodate her individual head size by varying the spacing between the edges 23, 24 bounding the slot 41. The opening 11 is preferably kept as small as possible while simultaneously being sufficiently large that the user can easily slip the garment 10 over her head without having to undo the fasteners prior to each use.

As is illustrated in FIG. 2, the front panel 12 further includes a trunk 15 from the sides of which a pair of bands 25, 26 extend laterally. Once the wearer's neck is in the opening 11, the caregiver can easily secure the mid-section of the front panel 12 and the bands 25, 26 about her waist by tying the bands together behind her back. The fasteners 44, 45 and the bands 25, 26 allow an adult person of almost any size to fit the garment 10 to her person.

Upwardly of the bands 25, 26, the trunk 15 flares outwardly (FIG. 2). The increase in width of the panel 12 from the bands 25, 26 to its junctures with the rear panels 13, 14 measures, by way of example, about 3.5 inches, the greatest span of the panel 12 between points thereon contiguous the bands 25, 26 being approximately 19 inches and between the uppermost points on its outer front edges 27, 28 being about 22.5 inches. Moreover, the upper portions of the outer edges 29, 31 of the panels 13, 14, when the garment 10 is laid flat without its being folded proximate the junctures between the panels 12 and 13 and between the panels 12 and 14, are disposed generally along straight lines which diverge only a few degrees at most from imaginary continuations of the edges 27, 28, respectively, when these continuations are drawn as straight lines aligned approximately parallel with the upper portions of the edges 27, 28.

As shown in FIG. 1, the upper, outwardly flared portions of the front panel 12 and the rear panels 13, 14 together form a pair of flared shoulder sections 30, 40 which lie across the entire width of the wearer's shoulders and extend laterally therefrom. The marked protuberance of the sections 30, 40 is due not only to presence of the outwardly flared portions of the panel 12 but also to the panels 12, 13, 14 being fabricated from the multilayered fabric 34 which has sufficient rigidity that the panels tend to bridge any depressions in the contour of the caregiver's body which may be contiguous thereto.

Moreover, the length of each of the panels 13, 14 measures, by way of example, approximately 15 inches and is comparable to one-half the length of the panel 12 or, alternately, to the distance between the uppermost points on the panel 12 and those points thereon contiguous the bands 25, 26. The latter distance measures, by way of example, approximately 14.5 inches. The elongation of the rear panels 13, 14 is hence sufficient to cover most of the wearer's back from her shoulders to her waist. Indeed, the extent of the protective covering offered by the garment 10 is such that a caregiver may don the garment 10 for last minute child care before leaving for work or for a social function and perform the necessary tasks without fear of soiling her clothes. At the same time, the panels 13, 14 are short enough that they hang free of the bands 25, 26 when these bands are tied together about the wearer's waist (FIG. 1). As a consequence, the garment 10, while covering the bulk of the wearer's torso, does not bind the user's arms in any way which could interfere with the free movement of her arms.

So that the wearer of the garment 10 may more easily attend to the needs of an infant, the garment is furnished with a plurality of pockets 16, 17, 18, 19 that are sized to fit the articles needed for the infant's care (FIGS. 1 and 2). The lower edge of each of the pockets 16, 17, 18, 19, like the edges of the panels 12, 13, 14 which are not stitched to each other, is preferably reinforced by binding 39. In addition, trim and embroidery 38 may be used to strengthen and to set off the upper edge of each pocket (FIGS. 2 and 4). The embodiment of the invention shown in FIGS. 1 through 4 is best suited for dressing and changing soiled diapers. The large pocket 16 is sized to store fresh diapers while the pockets 17, 18 and 19 can be utilized to hold powders, lotions, pins and even a milk bottle. Thus the garment 10 can be equipped so that the child can enjoy a few minutes of uninterrupted parental attention not only while being changed but afterwards as well.

Also furnished on the front panel 12 of the garment 10 is a sling 20, a first end of which is permanently secured to the front panel by stitching or the like. A second end 21 of the sling 20 is removably fastened to the panel 12, preferably by snap means. In the preferred embodiment, a decorative fabric broach 42 surrounds a cap 22 of snap means used to fasten the end 21 to the panel 12 (FIG. 2). The broach 42 helps focus the child's attention while he is being cared for. Other toys or pacifiers may also be suspended from the sling 20 itself. The garment can be altered in various ways within the basic concept of the invention. A first alternate embodiment is shown in FIGS. 5 and 6 and includes a garment 50 having a front panel 52 joined to two rear panels 53, 54. The panels 52, 53, 54 are similar to the panels 12, 13, 14, respectively, in shape and in the materials from which they are fabricated. Indeed respective panels would be nearly identical except for a difference in the pattern of stitching used in quilting the fabric from which the panels of each embodiment are formed. The garment 50 with its plurality of deep pockets 55 through 60 in which bottles of shampoo, baby oil, powders, lotions, and the like can be held is best suited for bathing a child. Moreover, a strap 51 provided near the juncture between the front panel 52 and the rear panel 53 can be utilized to hold a large bath towel (not shown) across the wearer's right shoulder. To facilitate the insertion of the towel beneath the strap 51, one end thereof is permanently attached to the body of the garment 10 and the other end is preferably releasably fastened to the garment by snap means of which only a cap 61 is illustrated (FIG. 5). In addition, a cloth fastener made of VELCRO R or the like having a face 62 is preferably stitched to the front panel 52 to provide a site for securing a wash cloth (not shown) or similar article to which has been attached a face engageable with the face 62.

A second alternate embodiment is shown in FIGS. 7 and 8 and includes a garment 70 having a front panel 72 joined to two rear panels 73, 74. The panels 72, 73, 74 are similar to the panels 52, 53, 54, respectively, in shape and in the materials from which type are fabricated. The garment 70 with its single deep pocket 75 and shallow pockets 76 through 80 is designed to hold a milk bottle, standard-sized jars of prepared baby food, and eating utensils. Also furnished on the front panel 72 of the garment 70 is a sling 81, a first end of which is permanently secured to the front panel by stitching or the like. A second end 82 of the sling 81 is removably fastened to the panel 72, preferably by snap means of which a cap 83 is shown in FIG. 8. The sling 81 is particularly useful for suspending articles such as a child's bib 84 on the front panel 82.

While several embodiments of the invention have been disclosed to illustrate the invention, other modifications within the scope of this invention will occur to those skilled in this particular art. It is therefore desired that the invention be measured by the appended claims rather than by the illustrative disclosure material set forth herein.

I claim:

1. An apron-type garment adapted to be worn by a caregiver for an infant comprising:

a. a front panel fabricated from an air permeable, multilayered material which gives the front panel sufficient rigidity that sections of the front panel situated proximate any depressions in the contour of the caregiver's body and tend to bridge the depressions so that the front panel forms a shield that makes only minimal contact with the caregiver's body;

b. means for securing the mid-section of the front panel about the caregiver's waist;

c. rear panels that are approximately one-half as long as the front panel, the rear panels being fabricated from the multilayered material; upper edges of the front panel and of first and second rear panels being joined together to form first and second junctures, respectively; the rear panels together covering most of the caregiver's back above the waist, contiguous portions of the front panel and of the rear panels covering the caregiver's shoulders and extending laterally therefrom; each of the rear panels having an inner edge, the inner edges being disposed proximate and alignable generally parallel to each other;

d. the front panel and the rear panels defining an opening which is sized large enough for the caregiver's head, the opening being disposed between the first and second junctures;

e. means for adjusting the size of the opening, the adjusting means including a pair of ties, each tie being attached to one of the inner edges and positioned so that the pair of ties can be fastened together; the garment, once the size of the opening is properly adjusted, being removable without undoing the fastening between the ties; and f. any points of attachment between the front panel and the first and second rear panels being disposed within the first and second junctures, respectively, so that the garment can be laid out flat and easily donned in a cape-like fashion.

2. An apron-type garment according to claim 1 which further comprises a plurality of pockets each attached to the front panel and sized to hold a specific item commonly used in the care of an infant.

3. An apron-type garment according to claim 1 which further comprises means for holding an article in contact with the front panel, the holding means including a sling, one end of the sling being releasably fastened to the front panel.

4. An apron-type garment according to claim 1 wherein the multilayered material is further characterized as being quilted, as being soft against the bodies of the caregiver and of the infant, and as being capable of absorbing moisture to protect the caregiver's clothes.

5. An apron-type garment according to claim 1 which further comprises means including a cloth fastener face for holding a small towel.

6. An apron-type garment adapted to be worn by a caregiver for a baby comprising:

a. a body with a front panel and a pair of rear panels, each of the rear panels having an inner edge, the inner edges being disposed proximate and alignable generally parallel to each other, the inner edges when aligned parallel and spaced apart defining a slot;

b. means for fastening together the proximate edges of the rear panels;

c. means for securing the mid-section of the front panel about the caregiver's waist;

d. the rear panels being approximately one-half as long as the front panel, the rear panels covering the caregiver's back above the waist except for the slot, contiguous portions of the front panel and of the rear panels covering the caregiver's shoulders and extending laterally therefrom beyond the caregiver's body;

e. the front panel and the rear panels defining an opening which is sized large enough for the caregiver's head, the opening communicating with the slot in the absence of said fastening together of the proximate edges of the rear panels;

f. means for adjusting the size of the opening, the adjusting means being attached to at least one of the proximate edges; the garment, once the size of the opening is properly adjusted, being removable without undoing any fastening between the proximate edges; and g. any juncture between the front panel and the first rear panel and between the front panel and the second rear panel being disposed proximate the opening and extending laterally therefrom, so that the garment can be laid out flat and easily donned in a cape-like fashion.

7. An apron-type garment according to claim 6 wherein the body of the garment is further characterized as being fabricated of a quilted fabric that feels soft to the baby and that absorbs moisture to protect the caregiver's clothes.

* * * * *